United States Patent [19]

Lambert et al.

[11] 4,144,065

[45] Mar. 13, 1979

[54] POLYSILICATES IN PHOTOGRAPHIC PRODUCTS AND PROCESSES

[75] Inventors: Ronald F. Lambert, Wayland; Karl J. Schreiber, Waban, both of Mass.

[73] Assignee: Polaroid Corporation, Cambridge, Mass.

[21] Appl. No.: 884,204

[22] Filed: Mar. 7, 1978

Related U.S. Application Data

[63] Continuation-in-part of Ser. No. 673,196, Apr. 2, 1976, abandoned, which is a continuation-in-part of Ser. No. 456,799, Apr. 1, 1974, abandoned, which is a continuation-in-part of Ser. No. 186,087, Oct. 4, 1971, abandoned.

[51] Int. Cl.[2] ..... G03C 7/00; G03C 1/40; G03C 5/54; G03C 5/30

[52] U.S. Cl. ..... 96/29 D; 96/3; 96/29 R; 96/66 R; 96/76 R; 96/76 C; 96/77; 96/84 R

[58] Field of Search ..... 96/3, 29 D, 66 R, 76 R, 96/77, 76 C, 29 R, 84 R

[56] References Cited

U.S. PATENT DOCUMENTS

| | | | |
|---|---|---|---|
| 3,265,501 | 8/1966 | Johnston | 96/29 R |
| 3,595,652 | 4/1971 | Farney | 96/76 R |
| 3,647,437 | 3/1972 | Land | 96/29 D |

OTHER PUBLICATIONS

Cab-O-Sil Properties and Functions, Cabot Corporation, Boston, Mass.

*Primary Examiner*—Richard L. Schilling
*Attorney, Agent, or Firm*—Louis G. Xiarhos; John P. Morley

[57] ABSTRACT

Novel photographic developing compositions adapted for the processing of an exposed film unit in the light, which processing compositions include at least one light-absorbing material and an inorganic cation exchange resin, e.g., an aluminosilicate polymer such as those present in natural or synthetic clays; and photographic systems employing the same.

20 Claims, 1 Drawing Figure

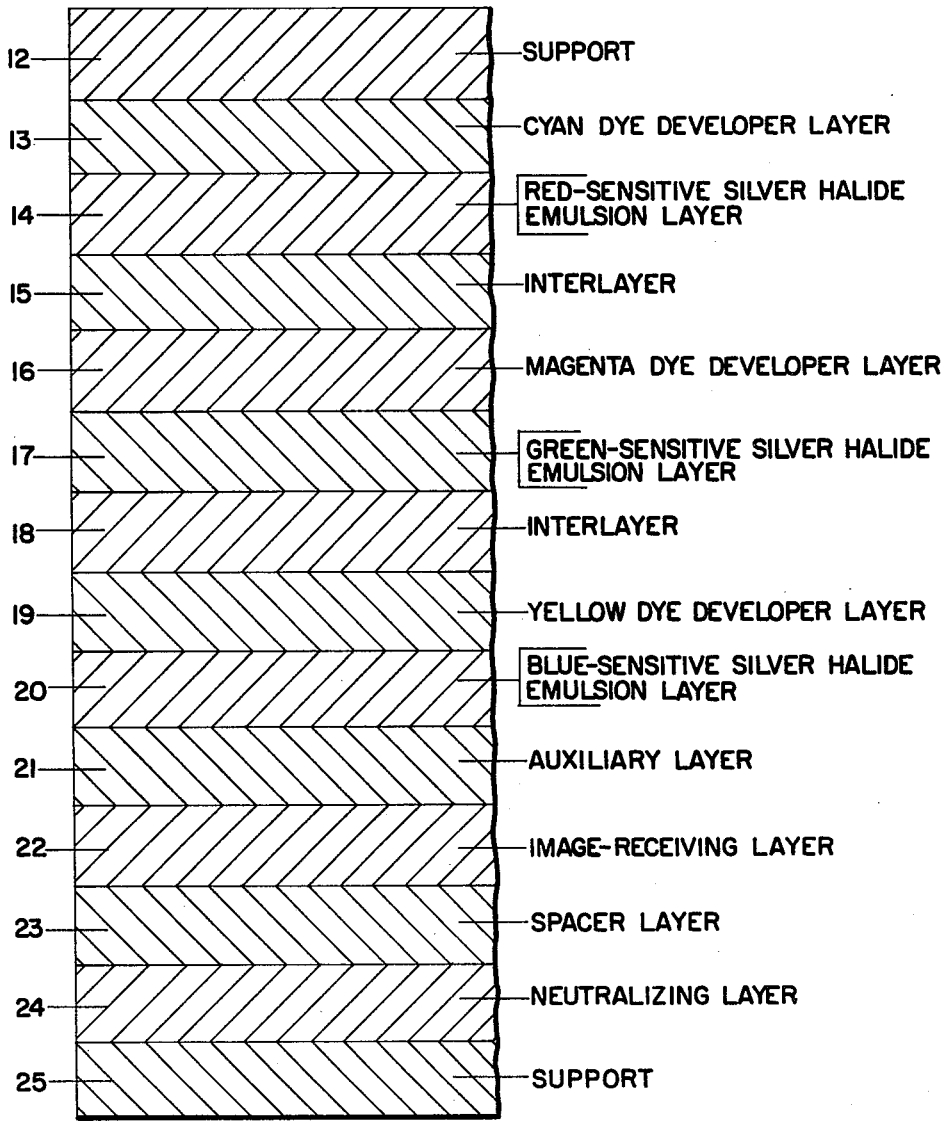
12
SUPPORT
13
CYAN DYE DEVELOPER LAYER
14
RED-SENSITIVE SILVER HALIDE EMULSION LAYER
15
INTERLAYER
16
MAGENTA DYE DEVELOPER LAYER
17
GREEN-SENSITIVE SILVER HALIDE EMULSION LAYER
18
INTERLAYER
19
YELLOW DYE DEVELOPER LAYER
20
BLUE-SENSITIVE SILVER HALIDE EMULSION LAYER
21
AUXILIARY LAYER
22
IMAGE-RECEIVING LAYER
23
SPACER LAYER
24
NEUTRALIZING LAYER
25
SUPPORT

POLYSILICATES IN PHOTOGRAPHIC PRODUCTS AND PROCESSES

CROSS-REFERENCE TO RELATED PATENT APPLICATIONS

This application is a continuation-in-part of U.S. application Ser. No. 673,196 filed Apr. 2, 1976 (now abandoned) which in turn is a continuation-in-part of U.S. application Ser. No. 456,799 filed Apr. 1, 1974 (now abandoned) which in turn is a continuation-in-part of U.S. application Ser. No. 186,087 filed Oct. 4, 1971 (now abandoned).

BACKGROUND OF THE INVENTION

A number of photographic processes by which images may be developed and viewed within seconds or minutes after exposure have been proposed. Such processes generally employ a processing composition which is suitably distributed between two sheet-like elements, the desired image being carried by one of said sheet-like elements. The resulting images may be in black-and-white, e.g., in silver, or in one or more colors. Processing may be conducted in or outside of a camera. The most useful of such processes are the diffusion transfer processes which have been proposed for forming silver or dye images, and several of these processes have been commercialized. Such processes have in common the feature that the final image is a function of the formation of an imagewise distribution of an image-providing reagent and the diffusion transfer of said distribution to or from the stratum carrying the final image, whether positive or negative. It has also been proposed to form the final desired image in the photosensitive stratum per se by monobath processing to obtain a negative image or by so-called direct position processing to obtain a positive image, employing processing techniques and physical film structures similar to those found useful in diffusion transfer processing.

The copending applications of Edwin H. Land, Ser. No. 786,352, filed Dec. 23, 1968 and now abandoned; Ser. No. 43,782, filedJune 5, 1970 and now abandoned; and Ser. No. 101,968, filed Dec. 28, 1970 and now abandoned, as a continuation-in-part of the first mentioned Ser. No. 786,352 now U.S. Pat. No. 3,647,437 relate to such photographic processes wherein development may be performed, at least in part, outside of a camera, i.e., in light actinic to the photosensitive layer or layers. These applications disclose systems wherein an organic light-absorbing material or reagent, preferably a dye, is included in the processing composition so as to preclude fogging by actinic light incident thereon, i.e., from that side of the film unit when the exposed film unit is processed in the light. The resulting "opaque" processing composition cooperates with opacifying means on the other side of the exposed photosensitive element, e.g., an opaque support layer, and means for precluding edge light leakage, so that, after application of the processing fluid, the film unit may be developed in the light.

The organic light-absorbing material may comprise a dye, sometimes referred to as an "indicator dye" which is highly colored within a first pH range but which is substantially transparent at a second pH range so as to permit viewing of the resulting photographic image. In one such embodiment, this light-absorbing dye may be highly colored at the pH of an aqueous alkaline processing composition, e.g., 13–14, but will be substantially non-absorbing of visible light at a lower pH, e.g., less than 10–12. This pH reduction may be effected by an acid-reacting reagent appropriately positioned in the film unit, e.g., a polymeric acid layer. The processing composition may, if necessary, contain a mixture of such light-absorbing materials so as to obtain light absorption in all critical areas of the visible and non-visible by which the photosensitive strata, e.g., a panchromatic black-and-white silver halide emulsion or a multiclor silver halide photosensitive element being used are exposable.

Suitable light-absorbing dyes of this description are disclosed in the aforementioned copending applications as well as in the following patents: U.S. Pat. No. 3,702,245; U.S. Pat. No. 3,833,615; U.S. Pat. No. 3,833,614; U.S. Pat. No. 3,702,244 and U.S. Pat. No. 3,772,329. Illustrative light-absorbing dyes will be detailed hereinafter.

Processing compositions including at least one light-absorbing organic material, e.g., the aforementioned indicator dyes, may be employed in various photographic systems, as is disclosed with greatest particularity in the aforementioned application Ser. No. 101,968. These photographic systems include systems for preparing reflection prints or transparencies, positive or negative, in black-and-white or in color. Color systems which may be employed include the various known additive or subtractive color systems, e.g., diffusion transfer, dye bleach, color processes employing an additive color screen, etc. Particularly useful photographic systems for forming visible images are those employing diffusion transfer techniques to provide an imagewise distribution of image-providing material which is transferred, by diffusion, to an image-receiving layer to impart thereto the desired photographic image. Illustrative diffusion transfer systems will be described hereinafter.

Common to all of these photographic systems contemplated by the present invention is the concept of forming the desired image by applying to the exposed film unit a processing composition including one or more organic light-absorbing materials such that the film unit may be protected from fogging by light incident on the thus applied processing composition during the development process.

Preferred processing compositions contemplated by this invention are those containing, in addition to the light-absorber, an inorganic light-reflecting agent providing the requisite background so that the resulting photographic image may be viewed by reflected light.

As was mentioned previously, particularly useful systems contemplated by this invention for forming photographic images are the various diffusion transfer systems for forming color images which have heretofore been disclosed in the art. Generally speaking, such systems rely for color image formation upon a differential in mobility or solubility of a dye image-providing material obtained as a function of development so as to provide an imagewise distribution of such material which is more diffusible and which is therefore selectively transferred, at least in part, by diffusion, to a superposed dyeable stratum to impart thereto the desired color transfer image. The differential in mobility or solubility may for example be obtained by a chemical action such as a redox reaction or a coupling reaction.

The dye image-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible in an imagewise pattern as a function of development. These materials may be complete dyes or dye intermediates, e.g., color couplers.

As examples of initially soluble or diffusible materials and their application in color diffusion transfer, mention may be made of those disclosed, for example, in U.S. Pat. Nos. 2,647,049; 2,661,293; 2,698,244; 2,698,798; 2,802,735; 2,774,668; and 2,983,606. As examples of initially non-diffusible materials and their use in color transfer systems, mention may be made of the materials and systems disclosed in U.S. Pat. Nos. 3,443,939; 3,443,940; 3,227,550; 3,227,551; 3,227,552; 3,227,554; 3,243,294 and 3,445,228.

In any of these systems, multicolor images are obtained by employing a film unit containing at least two selectively sensitized silver halide layers each having associated therewith a dye image-providing material exhibiting desired spectral absorption characteristics. The most commonly employed elements of this type are the so-called tripack structures employing a blue-, a green- and a red-sensitive silver halide layer having associated therewith, respectively, a yellow, a magenta and a cyan dye image-providing material.

A particularly useful system for forming color images by diffusion transfer is that described in U.S. Pat. No. 2,983,606, employing dye developers (dyes which are also silver halide developing agents) as the dye image-providing materials. In such systems, a photosensitive element comprising at least one silver halide layer having a dye developer associated therewith (in the same or in an adjacent layer) is developed by applying an aqueous alkaline processing composition. Exposed and developable silver halide is developed by the dye developer which in turn becomes oxidized to provide an oxidation product which is appreciably less diffusible than the unreacted dye developer, thereby providing an imagewise distribution of diffusible dye developer in terms of unexposed areas of the silver halide layer, which imagewise distribution is then transferred, at least in part, by diffusion, to a dyeable stratum to impart thereto a positive dye transfer image. Multicolor images may be obtained with a photosensitive element having two or more selectively sensitized silver halide layers and associated dye developers, a tripack structure of the type described above and in various patents including the aforementioned U.S. Pat. No. 2,983,606 being especially suitable for accurate color recordation of the original subject matter.

In color diffusion transfer systems of the foregoing description, color images are obtained by exposing a photosensitive element or "negative component" comprising at least a light-sensitive layer, e.g., a gelatino silver halide emulsion layer, having a dye image-providing material associated therewith in the same or in an adjacent layer, to form a developable image; developing this exposed element with a processing composition to form an imagewise distribution of a soluble and diffusible image-providing material; and transferring this imagewise distribution, at least in part, by diffusion, to a superposed receiving element or "positive component" comprising at least a dyeable stratum to impart to this stratum a color transfer image. The negative and positive components may be separate elements which are brought together during processing and thereafter either retained together as the final print or separated following image formation; or they may together comprise a unitary structure, e.g., integral negative-positive film units wherein the negative and positive components are laminated and/or otherwise physically retained together at least prior to image formation.

Of particular interest are those integral negative-positive film units adapted for forming color transfer images viewable without separation, i.e., wherein the positive component containing the dye transfer image need not be separated from the negative component for viewing purposes. In addition to the aforementioned essential layers, such film units further include means for providing a reflecting layer between the dyeable stratum and the negative component in order to mask effectively the silver image or images formed as a function of development of the silver halide layer or layers and any remaining associated dye image-providing material and to provide a background for viewing the color image formed in the dyeable stratum, without separation, by reflected light. This reflecting layer may comprise a preformed layer of a reflecting agent included in the essential layers of the film unit or the reflecting agent may be provided after photoexposure, e.g., by including the reflecting agent in the processing composition. These essential layers are preferably contained on a transparent dimensionally stable layer or support member positioned closest to the dyeable stratum so that the resulting transfer image is viewable through this transparent layer. Most preferably another dimensionally stable layer which may be transparent or opaque is positioned on the opposed surface of the essential layers so that the aforementioned essential layers are sandwiched or confined between a pair of dimensionally stable layers or support members, at least one of each is transparent to permit viewing therethrough of a color transfer image obtained as a function of development of the exposed film unit in accordance with the known color diffusion transfer system such as will be detailed hereinafter. In a particularly preferred form such film units are employed in conjunction with a rupturable container of known description containing the requisite processing composition and adapted upon application of pressure of applying its contents to develop the exposed film unit, e.g., by applying the processing composition in a substantially uniform layer between the dyeable stratum and the negative component. It will be appreciated that the film unit may optionally contain other layers performing specific desired functions, e.g., spacer layers, pH-reducing layers, etc.

Opacifying means may be provided on either side of the negative component so that the film unit may be processed in the light to provide the desired color transfer image. In a particularly useful embodiment such opacifying means comprise an opaque dimensionally stable layer or support member positioned on the free or outer surface of the negative component, i.e., on the surface of the film unit opposed from the positive component containing the dyeable stratum to prevent photoexposure by actinic light incident thereon from this side of the film unit and an opacifying agent applied during development between the dyeable stratum and the negative component, e.g., by including the opacifying agent in a developing composition so applied, in order to prevent further exposure (fogging) by actinic light incident thereon from the other side of the film unit when the thus exposed film unit is developed in the light. The last-mentioned opacifying agent may comprise the aforementioned reflecting agent which masks the negative component and provides the requisite background for viewing the transfer image formed thereover. Where this reflecting agent does not by itself provide the requisite opacity it may be employed in combination with an additional opacifying agent in order to prevent further exposure of the light-sensitive silver halide layer or layers by actinic light incident thereon.

As examples of such integral negative-positive film units for preparing color transfer images viewable without separation as reflection prints, mention may be made of those described and claimed in U.S. Pat. Nos. 3,415,644, 3,415,645, 3,415,646 and 3,473,925, 3,573,043, 3,573,044, 3,672,890, 3,594,165 and 3,594,164.

In general, the film units of the foregoing description, e.g., those described in the aforementioned patents and/or copending applications, are exposed to form a developable image and thereafter developed by applying the appropriate processing composition to develop exposed silver halide and to form, as a function of development, an imagewise distribution of diffusible dye image-providing material which is transferred, at least in part by diffusion, to the dyeable stratum to impart thereto the desired color transfer image, e.g., a positive color transfer image. Common to all of these systems is the provision of a reflecting layer between the dyeable stratum and the photosensitive strata to mask effectively the latter and to provide a background for viewing the color image contained in the dyeable stratum, whereby this image is viewable without separation, from the other layers or elements of the film unit. In certain of these systems, this reflecting layer is provided prior to photo-exposure, e.g., as a preformed layer included in the essential layers of the laminar structure comprising the film unit, and in others it is provided at some time thereafter, e.g., by including a suitable light-reflecting agent, for example, a white pigment such as titanium dioxide, in the processing composition which is applied between the dyeable stratum and the next adjacent layer to develop the latent image and to form the color transfer image.

The dye image-providing materials which may be employed in such processes generally are selected from those materials heretofore mentioned and disclosed in the illustrative patents which were initially soluble or diffusible in the processing composition but which are selectively rendered non-diffusible as a function of development or those which are initially insoluble or non-diffusible in the processing composition but are selectively rendered diffusible as a function of development. These materials may be complete dyes or dye intermediates, e.g., color couplers.

These film units may, and usually do, further contain pH modulating or adjusting means, e.g., a layer or layers containing a reagent for adjusting the pH following substantial transfer image formation. In those systems employing an aqueous alkaline processing composition, such film units may contain a neutralizing layer or layers, e.g., a polymeric acid layer of the type described, for example, in U.S. Pat. No. 3,362,819. It is also known to employ a spacer layer in conjunction with the neutralizing layer in order to "time" control the pH adjustment by the neutralizing layer. Spacer layers of this description are disclosed, for example, in the aforementioned U.S. Pat. No. 3,362,819, as well as in other patents, e.g., U.S. Pat. Nos. 3,455,686; 3,433,633; 3,421,893; 3,419,389; etc. The neutralizing and spacer layers are preferably contained in the positive component, e.g., as layers disposed on the side of the dyeable stratum opposed from the negative component. However, they may be disposed in the negative component, as is described and claimed in U.S. Pat. No. 3,573,043.

Preferred positive components employed in film units of the foregoing description comprise a transparent support or dimensionally stable layer carrying an acid neutralizing layer, a timing or spacer layer and a dyeable stratum or image-receiving layer. The positive component may also contain additional layers performing specific desired functions.

A preferred opacification system to permit development in the light is that described in the aforementioned copending application of Edwin H. Land, Ser. No. 43,782 — now abandoned — which employs a processing composition including an inorganic reflecting pigment dispersion containing at least one optical filter agent at a pH above the pKa of the optical filter agent in a concentration effective, when the processing composition is applied, to provide a layer exhibiting optical transmission density > than about 6.0 density units with respect to incident radiation actinic to the photosensitive silver halide layer and optical reflection density < than about 1.0 density with respect to incident visible radiation.

In lieu of having the reflecting pigment contained in the processing composition, e.g., as disclosed in the aforementioned copending application Ser. No. 43,782 — now abandoned — the reflecting pigment needed to mask the photosensitive strata and to provide the requisite background for viewing the color transfer image formed in the receiving layer may be contained initially in whole or in part as a preformed layer in the film unit. As an example of such a preformed layer, mention may be made of that disclosed on the copending applications of Edwin H. Land, Ser. Nos. 846,441, filed July 31, 1965 now U.S. Pat. No. 3,615,421 and 3,645, filed Jan. 19, 1970 now U.S. Pat. No. 3,620,724. The reflecting pigment may be generated in situ as is disclosed in the copending applications of Edwin H. Land, Ser. Nos. 43,741 and 43,742, both filed June 5, 1970 and now U.S. Pat. Nos. 3,647,434 and 3,647,435 respectively.

BRIEF DESCRIPTION OF DRAWING

The FIGURE is an enlarged, fragmentary, diagrammatic, sectional view of a film unit contemplated by this invention.

SUMMARY OF THE INVENTION

The present invention is directed to photographic systems of the foregoing description, specifically to processing compositions for use in such systems and which include at least one organic light-absorbing material, e.g., an "indicator dye" and which may optionally also include an inorganic light-reflecting agent, e.g., a white pigment, as well as a viscous reagent and the various photographic reagents to be employed in the particular photographic system. In accordance with the present invention, the processing composition will also contain an inorganic cation exchange resin, e.g., aluminosilicate polymers which may be present as such or included in a material containing it, e.g., the clays of this description, both natural and synthetic. The presence in such processing compositions of the cation exchange resin of this invention provides certain advantages which will be discussed in detail hereinafter.

DESCRIPTION OF PREFERRED EMBODIMENT

The preferred compositions of this invention include at least one indicator dye and the cation exchange resin and are employed to develop outside the camera a film unit as previously described including a positive component and a negative component to provide a diffusion transfer image which is viewable, without separation, as a reflection print. In its most preferred form, the processing compositions of this invention further include a light-reflecting agent, e.g., a white pigment such as titanium dioxide.

As was mentioned previously, the present invention is directed to processing compositions including at least one organic light-absorbing material and to photographic systems employing such a composition to provide a visible image.

A primary object of this invention, therefore, is to provide novel compositions of the foregoing description.

Another object is to provide novel compositions and photographic systems employing same wherein the exposed film unit may be developed in the light.

Still another object is to provide novel processing compositions including at least one indicator dye, which may be applied to an exposed film unit and the film unit then developed in the light to provide a visible image, viewable without separation, as a reflection print.

A still further object is to provide novel photographic processing compositions including colloidal magnesium aluminum silicate, an inorganic light reflecting agent and an organic light-absorbing material and photographic processes employing same.

Yet another object is to provide novel diffusion transfer systems wherein an exposed film unit is developed in the light to form a color transfer image.

Other objects of the invention will in part be obvious and will in part appear hereinafter.

The invention accordingly comprises the several steps and the relation and order of one or more of such steps with respect to each of the others, and the product possessing the features, properties and the relation of elements which are exemplified in the following detailed disclosure, and the scope of the application of which will be indicated in the claims.

As was stated previously, the present invention is directed primarily to those photographic systems wherein an exposed photosensitive element or film unit containing a developable image is processed in the light to form a visible image. Of particular interest are those systems wherein the film unit includes a negative component including at least one light-sensitive layer and a positive component including an image-receiving layer and the visible image is a diffusion transfer image which may be viewed, without separation as a reflection print.

For development to be permitted in the light, the negative component containing the photosensitive strata must be protected from both sides by suitable opacifying means, e.g., "sandwiched" between light-absorptive layers which will prevent fogging when the film unit is advanced from the camera into the light. In accordance with the disclosures of the aforementioned copending applications of Edwin H. Land, fogging may be prevented from one side of the film unit by employing a processing composition including one or more organic light-absorbing materials. Where the photosensitive strata are appropriately protected from actinic light from the other side, e.g., by disposing an opaque layer on the side of the photosensitive strata opposed from the side where the opaque processing composition is applied, the film unit may accordingly be processed in the light subsequent to distribution of the processing composition.

The use in the processing composition of organic light-absorbing materials which are highly colored at a first pH range and are substantially colorless at a second pH range, e.g., are highly colored during the development process to provide the requisite protection against fogging, but are substantially transparent following image formation, is of particular importance in the aforementioned integral negative-positive film units intended for the preparation of a visible image which is viewable without separation of the respective components. In general such film units include an opaque layer protecting the photosensitive strata from actinic light from one side or major surface, while the other side of the photosensitive element is transparent to permit exposure and for subsequent viewing of the image formed by development. The opaque processing composition is applied on this other side at some time following photoexposure to develop the latent image and to form the desired visible image, which development may then take place outside the camera. Following development, the opaque composition is rendered transparent, i.e., the light-absorptive material is "cleared", for example, by contacting the processing composition with an acid-reacting reagent to lower the pH from a first pH at which it is highly colored to a second pH at which it is substantially colorless, to permit viewing of the visible image contained in the photosensitive element from the side of the element to which the processing composition is applied. Where a light-reflecting agent is provided in the processing composition and/or as a preformed layer, this image may be viewed as a reflection print, due to the fact that the reflecting agent, preferably a white pigment, masks effectively the underlying strata and provides the desired background for so viewing by reflected light.

The drawing illustrates a film unit of this description for forming a color transfer image viewable, without separation, as a color reflection print.

As shown in the drawing, such a film unit may comprise, as the essential layers, a layer 13 of cyan dye developer, red-sensitive silver halide emulsion layer 14, interlayer 15, a layer of magenta dye developer 16, green-sensitive silver halide emulsion layer 17, interlayer 18, yellow die developer layer 19, blue-sensitive silver halide emulsion layer 20, auxiliary layer 21, image receiving layer or dyeable stratum 22, spacer layer 23, and a pH-reducing or neutralizing layer 24. Layers 13–21 comprise the negative component and layers 22–24 comprise the positive component. These essential layers are shown to be confined between a dimensionally stable layer or support member 12 which is preferably opaque so as to permit development in the light and dimensionally stable layer or support member 25 which is effectively transparent to permit viewing of a color transfer image formed as a function of development in receiving layer or dyeable stratum 22.

Layers 12 and 25 are preferably dimensionally stable liquid-impermeable layers which when taken together may possess a processing composition solvent vapor permeability sufficient to effect, subsequent to substantial transfer image formation and prior to any substantial environmental image degradation to which the resulting image may be prone, osmotic transpiration of processing composition solvent in a quantity effective to decrease the solvent from a first concentration at which the color-providing material is diffusible to a second concentration at which it is not. Although these layers may possess a vapor transmission rate of 1 or less gms./24 hrs./100 in. $^2$/mil., they preferably possess a vapor transmission rate for the processing composition solvent averaging not less than about 100 gms./24 hrs./100 in. $^2$/mil., most preferably in terms of the preferred solvent, water, a vapor transmission rate averaging in excess of about 300 gms. of water/24 hrs./100 in. $^2$/mil., and may advantageously comprise a microporous polymeric film possessing a pore distribution which does not unduly interfere with the dimensional stability of the layers or, where required, the optical characteristics of such layers. As examples of useful materials of this nature, mention may be made of those having the aforementioned characteristics and which are derived from ethylene glycol terephthalic acid; vinyl chloride polymers; polyvinyl acetate; cellulose derivatives, etc. As heretofore noted layer 12 is of sufficient opacity to prevent fogging from occurring by light passing therethrough, and layer 25 is transparent to permit photoexposure and for viewing of a transfer image formed on receiving layer 23.

The silver halide layers preferably comprise photosensitive silver halide, e.g., silver chloride, bromide or iodide or mixed silver halides such as silver iodobromide or chloroiodobromide dispersed in a suitable colloidal binder such as gelatin and such layers may typically be on the order of 0.6 to 6 microns in thickness. It will be appreciated that the silver halide layers may and in fact generally do contain other adjuncts, e.g., chemical sensitizers such as are disclosed in U.S. Pat. Nos. 1,574,944; 1,623,499; 2,410,689; 2,597,856; 2,597,915; 2,487,850; 2,518,698; 2,521,926; etc.; as well as other additives performing specific desired functions, e.g., coating aids, hardeners, viscosity-increasing agents, stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

The respective dye developers, which may be any of those heretofore known in the art and disclosed for example in U.S. Pat. No. 2,983,606, etc., are preferably dispersed in an aqueous alkaline permeable polymeric binder, e.g., gelatin as a layer from about 1 to 7 microns in thickness.

Interlayers 15, 18 and 21 may comprise an alkaline permeable polymeric material such as gelatin and may be on the order of from about 1 to 5 microns in thickness. As examples of other materials for forming these interlayers, mention may be made of those disclosed in U.S. Pat. No. 3,421,892 and the copending applications of Richard J. Haberlin, Ser. No. 854,491, filed Sept. 2, 1969, now U.S. Pat. No. 3,615,422 and Lloyd D. Taylor, Ser. No. 790,648, filed Jan. 13, 1969, now U.S. Pat. No. 3,575,700 etc. These interlayers may also contain additional reagents performing specific functions and the various ingredients necessary for development may also be contained initially in such layers in lieu of being present initially in the processing composition, in which event the desired developing composition is obtained by contacting such layers with the solvent for forming the processing composition, which solvent may include the other necessary ingredients dissolved therein.

The image-receiving layer may be on the order of 0.25 to 0.4 mil. in thickness. Typical materials heretofore employed for this layer include dyeable polymers such as nylon, e.g., N-methoxymethyl poly-hexamethylene adipamide; partially hydrolyzed polyvinyl acetate; polyvinyl alcohol with or without plasticizers; cellulose acetate with filler as, for example, one-half cellulose acetate and one-half oleic acid; gelatin; polyvinyl alcohol or gelatin containing a dye mordant such as poly-4-vinylpyridine, etc. Such receiving layers may, if desired, contain suitable mordants, e.g., any of the conventional mordant materials for acid dyes such as those disclosed, for example, in the aforementioned U.S. Pat. No. 3,227,550; as well as other additives such as ultraviolet absorbers, pH-reducing substances, etc. It may also contain specific reagents performing desired functions, e.g., a development restrainer, as disclosed, for example, in U.S. Pat. No. 3,265,498.

The spacer or timing layer may be on the order of 0.1 to 0.7 mil. thick. Materials heretofore used for this purpose include polymers which exhibit inverse temperature-dependent permeability to alkali, e.g., as disclosed in U.S. Pat. No. 3,445,686. Materials previously employed for this layer include polyvinyl alcohol, cyanoethylated polyvinyl alcohol, hydroxypropyl polyvinyl alcohol, polyvinyl methyl ether, polyethylene oxide, polyvinyl oxazolidinone, hydroxypropyl methyl cellulose, partial acetals of polyvinyl alcohol such as partial polyvinyl butyral and partial polyvinyl propional, polyvinyl amides such as polyacrylamide, etc.

The neutralizing layer may be on the order of 0.3 to 1.5 mil. in thickness. Materials used heretofore in the preparation of this layer include the polymeric acids disclosed in U.S. Pat. No. 3,362,819, e.g., dibasic acid half-ester derivatives of cellulose, which derivatives contain free carboxyl groups, e.g., cellulose acetate hydrogen phthalate, cellulose acetate hydrogen glutarate, cellulose acetate hydrogen succinate, ethyl cellulose hydrogen succinate, ethyl cellulose acetate hydrogen succinate, cellulose acetate hydrogen succinate hydrogen phthalate; ether and ester derivatives or cellulose modified with sulfoanhydrides, e.g., with ortho-sulfobenzoic anhydride; polystyrene sulfonic acid; carboxymethyl cellulose; polyvinyl hydrogen phthalate; polyvinyl acetate hydrogen phthalate; polyacrylic acid; acetals of polyvinyl alcohol with carboxy or sulfo substituted aldehydes, e.g., o-, m-, or p-benzaldehyde sulfonic acid or carboxylic acid; partial esters of ethylene/-maleic anhydride copolymers; partial esters of methylvinyl ether maleic anhydride copolymers; etc.

The film unit may be exposed through transparent layer 25 to form a developable image and thereafter developed by applying an aqueous alkaline processing composition including at least one organic light-absorbing material, e.g., one or more indicator dyes of the foregoing description which are highly colored at the pH of the alkaline processing composition and hence provide the necessary protection against actinic radiation incident thereon, and a suitable reflecting agent, e.g., a white inorganic material which will effectively mask the negative component and provide a suitable background for viewing the color transfer image formed in stratum 22 as a reflection print through transparent layer 25.

A preferred processing composition of this description is one of those described in the aforementioned copending application of Edwin H. Land, Ser. No. 43,782-now abandoned. As is disclosed and claimed in this application, it has been quite unexpectedly discovered that an improved film unit assemblage of the aforementioned general structural parameters and adapted to be processed, subsequent to photoexposure, in the presence of actinic radiation may be fabricated to employ, as the opacifying means interposed intermediate the reception layer and next adjacent silver halide layer subsequent to photo-exposure, an inorganic light-reflecting pigment dispersion containing reflecting pigment in a concentration per se insufficient, distributed as a layer intermediate the reception layer and next adjacent silver halide layer, to effectively prevent transmission of radiation actinic to the silver halide layer therethrough and at least one optical filter agent, at a pH above the pKa of the optical filter agent, in a concentration per se also insufficient to prevent transmission of actinic radiation therethrough, which concentrations individually and additively are together insufficient to prevent transmission of incident actinic radiation but in admixture are synergistically effective to provide a barrier to such transmission. Specifically, the inorganic light-reflecting pigment dispersion containing the optical filter agent in formulated to exhibit an optical transmission density $> \sim 6.0$ density units and an optical reflection density $< \sim 1.0$ density units at a pH above the pka of the optical filter agents included.

In accordance with that discovery, the optical filter agent will be employed in a concentration, itself ineffective to provide the required transmission density alone or, theoretically, in combination with the inorganic light-reflecting pigment, as projected by Beer's Law, that is, $D_T = ECl$ wherein $D_T$ is transmission density, E is the epsilon of the optical filter agent, C is the concentration and l is the radiation path length, but empirically effective in combination with the pigment to prevent transmission of radiation actinic to the silver halide layers incident on the layer comprising the dispersion, during processing in the presence of actinic radiation, and sufficiently low to provide substantially immediate viewing of transfer image formation against the background provided by the reflecting pigment. Such effective minimal concentration of filter agent specifically facilitates the acceleration of the clearing time involved in discharging from visual observation the filter agent employed by reduction of the environmental pH as detailed above from above to below the pka of the filter agent selected.

The film unit assemblage constructed in accordance with this discovery is specifically adapted for processing in the presence of actinic radiation by reason of the protection afforded the silver halide layer's exposure surface by the presence of the pigment dispersion protecting from exposure such surface, and for the simultaneous viewing of the transfer image carried by the reception layer by reason of the minimal optical reflection density exhibited by the light-reflecting pigment layer, subsequent to photoexposure of the silver halide layer and formation of the pigment layer. There is thus provided substantially immediate viewing of transfer image formation against a reflecting pigment layer background exhibiting minimal contamination provided by the minor concentration of substantially masked optical reflecting agent now discovered to be necessary to prevent transmission of fog producing actinic radiation through the reflecting layer and thus protecting the silver halide layer during transfer processing. The de minimus concentration of optical filter agent unexpectedly discovered to be capable of effective employment to prevent light transmission when dispersed in intimate relationship with reflecting pigment optimizes discharge of the minimal reflectivity contamination as is so provided by the agent upon decrease of the environmental pH from that at which the optical filter agent absorbs radiation to that at which such agent is substantially innocuous optically.

A particularly preferred reflecting agent comprises titanium dioxide due to its highly effective reflection properties. In general, in such preferred embodiment, based upon percent titanium dioxide (weight/volume) reflecting layers provided by processing compositions containing titanium dioxide dispersed in water in a concentration to give about 1500 to 4000 mgs./ft$^2$ of titanium dioxide when solidified will provide a percent reflectance of about 85 to 90%. In the most preferred embodiments, the percent reflectance particularly desired will be in the order of $\sim$ 85%.

In embodiments wherein the dispersion comprises a preformed layer positioned intermediate the reception layer and next adjacent silver halide layer, the pigment layer will be sufficiently transparent to allow transit of exposing radiation through the pigment layer and may comprise titanium dioxide reflecting agent possessing a particle size distribution averaging $< \sim 0.2$ micron in diameter and preferably $< \sim 0.05$ micron in diameter as initially present preceding exposure of the film unit, which preferred materials, upon contact with aqueous alkaline processing composition, preferably aggregate to provide particles possessing a diameter in excess of $\sim$ 0.2 micron in diameter and will be coated at a coverage of $\sim$ 200 to 1000 mgs./ft.$^2$. Specifically, the reflecting agent will be present in a quantity insufficient to prevent exposure of the emulsion layers by actinic radiation incident on the dimensionally stable transparent layer of the film unit but in a concentration sufficient, subsequent to processing, to mask due developer associated with the silver halide emulsion strata from the dye transfer image. In the preferred construction of such embodiment, the pigment such as titanium dioxide will be initially present in a relatively small particle size to provide unexpectedly efficient transit of radiation through the reflecting layer during exposure which upon contact with an alkaline processing composition and aggregation of the pigment particles provides efficient light reflectivity and masking capacity subsequent to such aggregation.

In general, the reflecting agents to be employed are those which remain substantially immobile within their respective compositions during and subsequent to photographic processing and particularly those which comprise insoluble and nondiffusible inorganic pigment dispersions within the layer in which they are disposed.

Where desired, reflecting agent pigment may thus be distributed in whole or in part within a processing composition permeable polymeric matrix such as gelatin and/or any other such polymeric matrixes as are specifically denoted throughout the specification as suitable for employment as a matrix binder and may be distributed in one or more of the film unit layers which may be separated or contiguous, intermediate the image-receiving layer and next adjacent silver halide layer, provided that its distribution and concentration is effective to provide the denoted post processing masking function, and/or in whole or in part the reflecting agent may be ultimately disposed within the processing composition residuum located intermediate the image-receiving layer and next adjacent silver halide emulsion strata and associated dye image-forming material.

The optical filter agent selected should be one exhibiting, at a pH its pKa, maximum spectral absorption of radiation at the wavelengths to which the film unit's photosensitive silver halide layer or layers are sensitive and should be substantially immobile or nondiffusible within the pigment dispersion, during performance of its radiation filtration function, in order to maintain and enhance the optical integrity of the dispersion as a radiation filter unit functioning in accordance with the present invention, and to prevent its diffusion into and localized concentration within the image-receiving layer thereby decreasing the efficiency of the reflecting pigment dispersion as a background against which image formation may be immediately viewed, during the initial stages in the diffusion transfer processing of the film unit, by filter agent absorption of dispersion reflected visible radiation prior to reduction in the environmental pH below the pKa of the agent. Commensurate with the spectral sensitivity range of the associated silver halide layer or layers, the optical filter agent selected may comprise one or more filter dyes possessing absorption complementary to such silver halide layers in order to provide effective protection against fog-providing radiation during processing. Recognizing that the filter agent absorption will derogate from image-viewing characteristics by contaminating reflecting pigment background, the selected agents must be those exhibiting major spectral absorption at the pH at which processing is effected and minimal absorption at a pH below that which obtains during transfer image formation. Accordingly, the selected optical filter agent or agents must possess a pKa below that of the processing pH and above that of the environmental pH subsequent to transfer image formation, and will be selected for employment in the minimum concentration necessary to provide an optical transmission density $>\sim 6.0$ at wavelengths at which the silver halide layer is maximally responsive, and in no instance an optical reflection density $<\sim 1.0$ at such wavelengths.

As was mentioned previously, indicator dyes useful as the organic light-absorptive material have been disclosed in certain of the aforementioned patents and copending applications. Examples of such dyes are disclosed in U.S. Pat. No. 3,647,437 beginning at Column 23, line 30 and this patent and disclosure are expressly incorporated here by reference.

The foregoing description is by way of background and in general represents what has been discovered prior to the present invention. The present invention is therefore in a sense directed to improvements in such systems which have been found to obviate certain problems encountered in these prior systems.

Upon development of film units of the foregoing description with a processing reagent including a dispersion comprising one or more organic light-absorbing materials and a light-reflecting agent, e.g., a composition of the type defined in the aforementioned application Ser. No. 43,782 including one or more indicator dyes and a white pigment, certain visual problems have been observed in the color transfer image so formed, whether it be developed in the dark in known manner or in the presence of actinic light, as heretofore explained. These visual problems, manifested as "raindrop-like" streaks are believed to be caused by a phase separation whereby certain random areas of the spread composition suffer a loss or reduction of light-reflecting agent, e.g., white pigment. Where the film unit is developed in the dark, these streaks take the form of "dark" streaks of enhanced dye density, apparently caused by faster or greater dye transfer in these random areas of reduced pigment, during the development period, in turn causing greater dye density in these areas of the developed print. On the other hand, if the film unit is developed in the presence of actinic light, e.g., outside the camera in accordance with the procedures contemplated in the foregoing description fogging of the negative in these random areas is caused by the presence of insufficient pigment (the reduction or loss of pigment may, for example, lower the optical density of the spread reagent from about 6 to about 2), thereby resulting in immobilization of dye in these areas where dye should normally be free to diffuse, in turn causing white streaks to be present in the shadow (dye-containing) areas of the developed print. It will be appreciated that the white streaks so appearing in the print developed in the light correspond areawise to the "dark" streaks appearing in the print developed in the dark. In either instance, the resulting streaks adversely affect the quality of the color print.

As was mentioned previously, this problem is believed to be caused by a phase separation of the dispersion-containing processing reagent. In any event, that the phase separation does in fact occur has been documented both qualitatively with photomicrographs and quantitatively with Cary transmission spectra. This phase separation is most pronounced when the processing fluid contains a quaternary salt of the type described in U.S. Pat. No. 3,173,786, e.g., an onium compound such as N-benzyl-$\alpha$-picolinium bromide.

In accordance with the present invention, this problem has been found to be markedly reduced if not totally obviated by including in the processing reagent an effective amount of an inorganic polymeric cation exchange resin which, it will be appreciated, should be photographically innocuous, e.g., not interfere with the development process, as well as being compatible with the other reagents in the processing composition and stable at the particular pH of the processing composition employed. Broadly, the polymeric cation exchange resins suitable in the practice of the present invention are those natural and synthetic resins providing a cation exchange capacity between about 0.45 to about 2.70 millequivalents of cation per gram of resin. The cation exchange capacity (C.E.C.) is a property of such resins well known to the art and details relating to the C.E.C. of resins may be found in "Cation Exchange Constants For Clays From Electrochemical Measurements" Proceedings of Twelfth Conference on Clays and Clay Minerals, W. F. Bradly Edition; Oct. 2, 1963, pages 397–421.

The cation exchange resin so employed should preferably be white or substantially colorless in order not to affect adversely the aesthetic qualities of the desired color print, unless amounts are used which are so slight that the color of the print would not be noticeably affected by the presence of a colored resin, or unless the naturally colored resin is bleached either before incorporation in the processing composition or in situ, for example with ethylene diamine tetraacetic acid (EDTA). It should also preferably provide a particle size distribution which is submicron, e.g., no greater than about 0.22 micron in order to provide, upon spreading of the processing composition, a layer which appears visually uniform when the resulting image is viewed.

The preferred cation exchange resins contemplated by this invention are the natural and synthetic clays comprising resins providing the cation exchange capacity described above. Particularly preferred clays are those comprising polysilicates or phyllosilicates such as polyaluminosilicates, polymagnesiumsilicates, polymagnesiumaluminosilicates and the like. The preferred naturally occurring polysilicates in general belong to the montmorillonite group of minerals and may occur in nature in admixture with various other elements and/or compounds.

As examples of such useful materials mention may be made of aluminum magnesium silicates such as attapulgites, such as "Pharmasorb" trade name of Englehard Minerals and Chemicals Corporation for an activated attapulgite typically containing about 67.0% silicon dioxide, 12.5% aluminum oxide, 11.0% magnesium oxide, 4.0% ferric oxide, 2.5% calcium oxide and 3.0% others; "Mineral Colloid BP" trade name of Georgia Kaolin Company for a highly refined montmorillonite, a naturally occurring colloid, light amber in color, fine thin flakes or microgranules, insoluble in water and organic solvents but dispersing in water to form a colloidal suspension, pH around 8.5–9.5, typically containing about 58.2% silicon dioxide, 23.1% aluminum oxide, 4.0% ferric oxide, 2.5% magnesium oxide and other oxides; "Astra-tone 40" trade name of Georgia Kaolin Company for an organic-modified montmorillonite, a light buff powder; "Gelwhite L" trade name of Georgia Kaolin Company for a white montmorillonite with very low iron content, calcium and sodium being the major exchangeable cations, microgranular in form, insoluble in water and organic solvents but dispersing easily in water to form a colloidal suspension, pH about 8.5–9.5, typically containing 60.8% silicon dioxide, 21.5% aluminum oxide, 3.62% magnesium oxide, 0.9% ferric oxide, 2.21% calcium oxide, 1.30% sodium oxide, as well as other compounds; "Gelwhite GP" trade name of Georgia Kaolin Company for a white purified colloidal montmorillonite with predominantly sodium ions in exchange positions, dispersing readily in water to form a translucent gel, pH about 9.5–10, typical chemical analysis indicating 58.6% silicon dioxide, 21.2% aluminum oxide, 4.07% sodium oxide, 3.79% magnesium oxide, 2.42% calcium oxide, 0.97% ferric oxide, as well as other compounds; and "Bentolite" trade name of Georgia Kaolin Company for a white bentonite treated to eliminate the major portion of iron and other color producing impurities, e.g., "Bentolite L", pH about 7, a white powder typically containing 71.65% silicon dioxide, 15.67% aluminum oxide, 3.64% magnesium oxide, 1.66% calcium oxide, 0.34% ferric oxide, as well as other oxides, "Bentolite L-2", a white powder, pH about 7.0, typically containing about 71.53% silicon dioxide, 15.39% aluminum oxide, 3.63% magnesium oxide, 1.66% calcium oxide, 0.72% ferric oxide, as well as other oxides, and "Bentolite H", a white powder, pH about 9.5, typically containing 69.20% silicon dioxide, 14.50% aluminum oxide, 3.35% magnesium oxide, 1.05% calcium oxide, 0.66% ferric oxide, as well as other oxides; synthetic clays such as "Barasym - SMM -- $Na^+$" trade name of National Lead Company, Baroid Division, for a synthetic muscovite - mica - interstratified montmorillonite with sodium surface charge, "Barasym - SMM -- $K^+$" trade name of National Lead Company, Baroid Division, for a synthetic muscovite - mica - interstratified montmorillonite with potassium surface charge, "Saponite" trade name of National Lead Company, Baroid Division, for a synthetic magnesium aluminum silicate clay, "Lithium Synthetic Hectorite SMH-3" trade name of National Lead Company, Baroid Division, for a synthetic magnesium fluorosilicate polymer with lithium hydroxide surface hectorite clay, "Sodium Synthetic Hectorite MSL-306" trade name of National Lead Company, Baroid Division, for a synthetic magnesium fluorosilicate polymer with sodium hydroxide surface hectorite clay, etc.

Still other suitable resins or phyllosilicates that could be mentioned include a one:one layer lattice trioctahedral silicate having the molecular formula $Mg_3Si_2O_5(OH).XH_2O$ and supplied by Baroid Division of N. L. Industries under the trade designation "Synthetic Crysotile-MSL-369". Also, a chrysotile material supplied by Union Carbide under the trade designation "Calidrea Asbestos RG-244" and having the formula $Mg_3Si_2O_5(OH)_4$ may be employed. Other suitable cationic resins, both natural and synthetic, will be readily suggested to those skilled in the art in the light of this description.

As was mentioned previously, the present invention contemplates the addition of effective amounts of an inorganic polymeric cation exchange resin, e.g., a clay such as illustrated above, to the processing composition employed with the film units and systems employing the same to which this invention is directed. As used herein and in the appended claims, the term "effective amount" means an amount effective to provide marked or noticeably improved results. While the amounts so employed are not capable of precise quantitative definitions, varying in accordance with such factors as the additive itself, the precise formulation of the particular processing composition in which it is used, etc., in general beneficial results may be obtained with as little as 1%, by weight, of the processing composition, although amounts on the order of 3% or more are generally used.

As heretofore mentioned, the employment of the additives of this invention in the processing composition inhibits the aforementioned "streak" problem in the resulting color transfer image. In addition, certain other significant advantages are obtained, chief of which is the capability of getting cleaner highlights, possibly due to increased efficiency of the reflecting agent in masking the underlying negative component; and the ability to obtain higher low shear viscosity of the processing composition, making for a more stable viscous composition which still permits of uniform spreading under high shear, e.g., by rupturing a pod or frangible container of the same by compressive pressure to dispense the composition and thereby develop the exposed film unit.

The processing compositions of this invention may include the various other photographic reagents heretofore employed in the art to prepare color transfer images with the film units to which this invention is directed. In addition to the reflecting agent and opacifying dye or dyes, they may, for example, include a viscosity-increasing reagent such as hydroxyethyl cellulose, carboxymethyl cellulose, etc., an alkaline material such as sodium, lithium, or potassium hydroxide, antifoggants, and the various other photographic reagents heretofore employed in processing compositions for preparing color images.

Illustrative processing compositions contemplated by this invention may, for example, comprise the following proportions of ingredients:

| PROCESSING COMPOSITION A | |
|---|---|
| Water | 100.0 cc. |
| Carboxymethyl cellulose | 2.5 gms. |
| N-phenethyl-α-picolinium bromide | 1.76 gms. |
| Benzotriazole | 1.0 gms. |
| 5-hydroxy-4-azabenzimidazole | 0.10 gms. |
| 6-bromo-5-methyl-4-azabenzimidazole | 0.05 gms. |
| Potassium hydroxide | 9.75 gms. |
| Titanium dioxide | 50.00 gms. |
| Opacifying Dye of Formula A | 1.72 gms. |
| Opacifying Dye of Formula B | 1.15 gms. |
| "Mineral Colloid BP" | 5.0 gms. |
| **PROCESSING COMPOSITION B** | |
| Water | 100.0 cc. |
| Carboxymethyl cellulose | 3.10 gms. |
| N-phenethyl-α-picolinium bromide | 2.05 gms. |
| 6-methyl uracil | 2.0 gms. |
| Cesium hydroxide | 8.3 gms. |
| 5-hydroxy-4-azabenzimidazole | 0.10 gms. |
| 6-bromo-5-methyl-4-azabenzimidazole | 0.99 gms. |
| Potassium hydroxide | 7.2 gms. |
| Titanium dioxide | 50.00 gms. |
| Opacifying Dye of Formula A | 3.5 gms. |
| Opacifying Dye of Formula B | 1.7 gms. |
| "Calidria Asbestos RG-244" | 3.0 gms. |
| "Barysym-SMM-Na" | 3.0 gms. |
| **PROCESSING COMPOSITION C** | |
| Water | 100.0 cc. |
| Carboxymethyl cellulose | 2.77 gms. |
| N-phenethyl-α-picolinium bromide | 1.0 gms. |
| Benzotriazole | 2.0 gms. |
| 6-bromo-5-methyl-4-azabenzimidazole | 0.5 gms. |
| Potassium hydroxide | 11.08 gms. |
| Titanium dioxide | 70.00 gms. |
| Opacifying Dye of Formula A | 3.3 gms. |
| Opacifying Dye of Formuula B | 1.6 gms. |
| "Barasym-SMN-Na" | 5.5 gms. |

Opacifying dye of Formula A has the following structure:

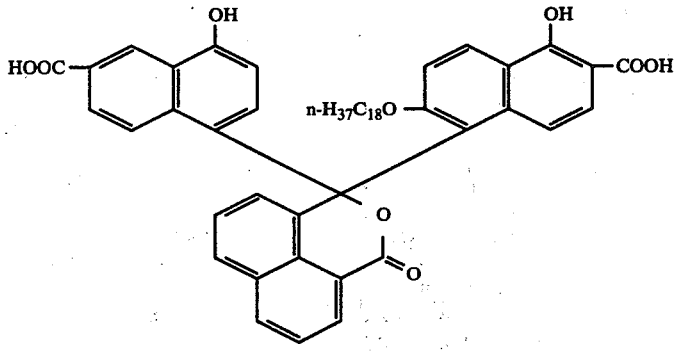

Opacifying dye of Formula B has the following structure:

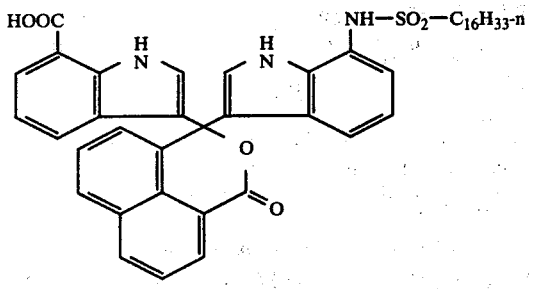

To further illustrate the practice of this invention, a film unit of the type contemplated by this invention may be prepared, for example, by coating, in succession, on a gelatin subbed, 4 mil. opaque polyethylene terephthalate film base, the following layers:

1. A layer of cyan dye developer dispersed in gelatin and coated at a coverage of about 80 mgs./ft.$^2$ of dye and about 100 mgs./ft.$^2$ of gelatin;

2. A red-sensitive gelatino-silver iodobromide emulsion coated at a coverage of about 225 mgs./ft.$^2$ of silver and about 50 mgs./ft.$^2$ of gelatin;

3. A layer of acrylic laytex sold by Rohm and Haas Co. under the trade designation AC-61 and polyacrylamide coated with a coverage of about 100 mgs./ft.$^2$ of Ac-61 and about 5 mgs./ft.$^2$ of polyacrylamide;

4. A layer of magenta dye developer dispersed in gelatin and coated at a coverage of 70 mgs./ft.$^2$ of dye and about 120 mgs./ft.$^2$ of gelatin;

5. A green-sensitive gelatino-silver iodobromide emulsion coated in a coverage of about 120 mgs./ft.$^2$ of silver and 60 mgs./ft.$^2$ of gelatin;

6. A layer comprising the acrylic laytex sold by Rohm and Haas Co. under the trade designation B-15 and polyacrylamide coated in a coverage of about 100 mgs./ft.$^2$ of B-15 and about 10 mgs./ft.$^2$ of polyacrylamide;

7. A layer of a yellow dye developer and the auxiliary developer 4'-methylphenyl hydroquinone dispersed in gelatin and coated at a coverage of about 50 mgs./ft.$^2$ of dye, about 15 mgs./ft.$^2$ of auxiliary developer and 50 mgs./ft.$^2$ of gelatin;

8. A blue-sensitive gelatino-silver iodobromide emulsion coated at a coverage of about 65 mgs./ft.$^2$ of silver and 75 mgs./ft.$^2$ of gelatin;

9. A layer of gelatin coated at a coverage of about 50 mgs./ft.$^2$ of gelatin.

The three dye developers employed above may be the following:

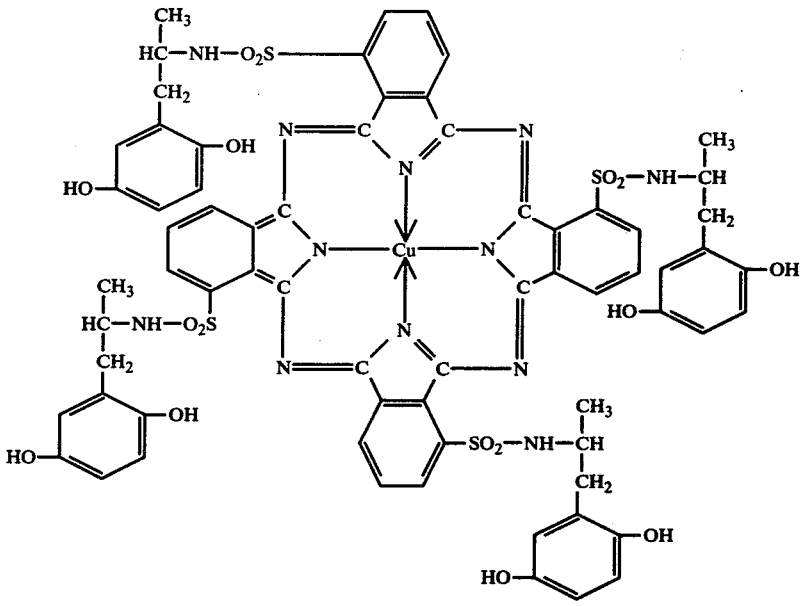

a cyan dye developer;

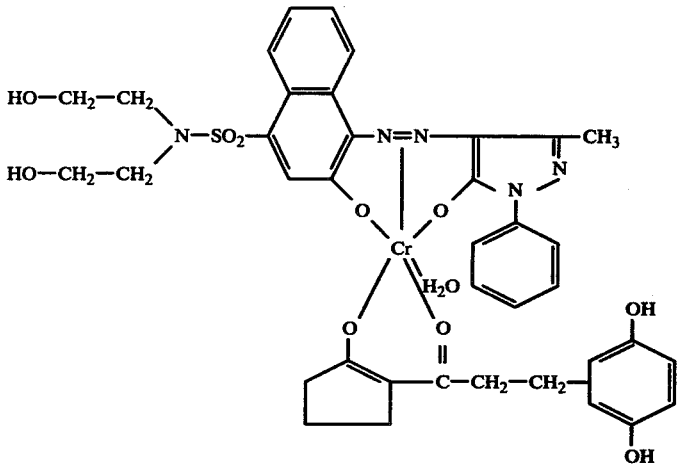

a magenta dye developer;

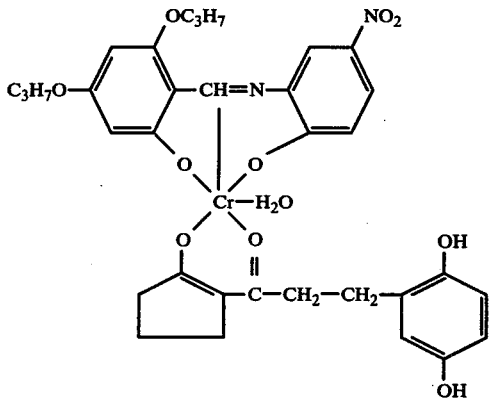

a yellow dye developer.

Then a transparent 4 mil. polyethylene terephthalate film base may be coated, in succession, with the following illustrative layers:

1. a polymeric acid neutralizing layer containing a 7:3 mixture, by weight, of polyethylene/maleic anhydride copolymer and 88–90% hydrolyzed polyvinyl acetate at a coverage of about 1000 mgs./ft.$^2$;

2. a graft copolymer of acrylamide and diacetone acrylamide on a polyvinyl alcohol backbone in a molar ratio of 1:3.2:1 at a coverage of about 800 mgs./ft.$^2$, to provide a polymeric spacer or timing layer; and 3. a 2:1 mixture, by weight, of polyvinyl alcohol and poly-4-vinylpyridine, at a coverage of about 900 mgs./ft.$^2$ and including about 20 mgs./ft.$^2$ of 1-phenyl-5-mercaptotetrazole, to provide a polymeric image-receiving layer containing development restrainer.

The two components may then be laminated together to provide an integral film unit of the type shown in the drawing.

A rupturable container comprising an outer layer of lead foil and an inner liner or layer of polyvinyl chloride retaining an aqueous alkaline processing solution including the additive of this invention, e.g., a composition of the foregoing illustrative formulation, may then be fixedly mounted on the leading edge of each of the laminates, by pressure-sensitive tapes interconnecting the respective containers and laminates, such that, upon application of compressive pressure to the container, its contents may be distributed upon rupture of the container's marginal seal, between the dyeable stratum and the next adjacent layer of the negative component.

This film unit may then be exposed to provide a developable image and then processed by applying compressive pressure to the container, e.g., by passing between a pair of pressure rollers in known manner, to apply the processing composition and thereby form a color transfer image in the image-receiving layer which, as heretofore described, may be viewed by reflected light through the transparent support. Development of the photoexposed silver halide layer is achieved in manners known to the art by known silver halide developing reagents some or all of which may be included in either the processing composition or in the film unit or in both so that the processing composition provides the silver halide developing capability, e.g., reagents for the photoexposed silver halide layer. Also as heretofore mentioned, due to the fact that the negative component is effectively protected from actinic light during the development period, the film unit may be processed in the light, e.g., by passage from a camera or like exposing chamber through the pressure-applying rollers into the light, to provide the desired color image.

Inclusion of the cation exchange resins of this invention in the processing composition for film units as illustrated above has been found to inhibit effectively the problems noted previously and to provide the aforementioned significant advantages, all contributing to a color image of greatly improved appearance and quality.

In the foregoing discussion and illustrative example, the processing composition contains sufficient opacifying agent, e.g., reflecting pigment and opacifying dye, at the coverage applied to provide the requisite opacity so that the film unit can be processed in the light. It will be appreciated that the coverage necessary to accomplish this function is in part dependent upon the concentration of opacifying materials contained in the processing composition and is also in part dependent upon the gap between the layers where it is applied or the thickness of the layer of opacifying material containing composition so applied. To illustrate this point, a quantity of processing fluid on the order of a little in excess of 3 grams containing a particular amount of opacifying materials, e.g., the illustrative composition previously described, may be sufficient when applied at a gap of 0.0032" between layers of a film unit on the order of 3½" × 3½". Lesser proportions of opacifying materials may be employed at greater gaps (thicker layers); and, conversely, greater proportions are needed at smaller gaps. It will be appreciated that employment of thicker gaps or layers for a film unit of given dimensions requires greater amounts of processing fluid and, conversely, thinner gaps require the use of less fluid in order to prevent the presence of excess fluid which may leak out from at least one side of the film unit unless appropriate liquid trapping means are provided to contain this excess fluid.

When thinner gaps are employed with a given reagent having specified amounts of reagents, it will be appreciated that less of these particular reagents will be present after application of the processing composition per unit surface area of the film unit than when thicker gaps are employed with the same processing composition. Hence, with such thinner gaps, it is usually necessary to increase the concentrations of these reagents in the processing fluid in order to compensate for the fact that less fluid is applied per unit surface area of the film unit.

Thus, for example, the amount or concentration of opacifying agent or agents, e.g., opacifying dyes, sufficient to provide the requisite opacity upon spreading at a given gap or thickness will not necessarily be sufficient when the same processing composition is applied at a lower gap, due to the fact that fewer molecules of the dye are present between the light source and the photosensitive strata. It will accordingly be necessary to employ greater concentrations of opacifying agent in such compositions in order to in turn apply a sufficient number of molecules of this agent to provide the desired opacity. While this may seem to be a simple matter, it has been found that, when thinner gaps are desired, it is not so simple as it seems merely to increase the concentrations to levels needed at these thinner gaps. Thus, for example, in processing compositions such as the one previously illustrated including an aqueous medium, a viscosity-increasing agent such as hydroxyethyl cellulose or carboxymethyl cellulose, a reflecting agent, e.g., a white pigment such as titanium dioxide, one or more opacifying dyes, and any additional photographic reagents, any attempts to increase the amount of opacifying dye beyond a particular concentration in a given composition will result in a phase separation which renders the resulting composition completely unacceptable for its contemplated purpose.

Another aspect of this invention is directed to this particular problem. In accordance with this invention, it has been found that the addition of the aforementioned cation exchange resins makes it possible to increase the concentration of opacifying dye without the problem of phase separation. The amount of resin employed for this purpose, generally speaking, will be at least 3% by weight and preferably at least 10%. With the use of greater amounts, some or all of the viscosity-increasing reagent normally employed in photographic compositions to be confined in a pod or rupturable container may be replaced.

By way of further illustration of this aspect of the invention, a processing composition including:

| | |
|---|---|
| Water | 100.0 cc |
| Potassium hydroxide | 9.75 gms. |
| Carboxymethyl cellulose | 3.5 gms. |
| Titanium dioxide | 50.0 gms. |
| Opacifying Dye of Formula A | 1.72 gms. |
| Opacifying Dye of Formula B | 1.15 gms. |

will provide the requisite opacity with a given film unit when applied at a gap of 0.0032", but will not provide the desired opacity when applied to develop the same film unit at smaller gaps, e.g., gaps on the order of 0.0022". On the other hand, employment of these smaller gaps are sometimes expedient or advisable for such purposes as conserving space so that a greater number of individual film units may be stacked in a given cassette or container. Attempts to increase the concentrations of opacifying dye to necessary amounts, e.g., doubling these amounts, results in the phase separation mentioned above.

In accordance with this invention, the necessary opacity and viscosity for the same film unit may be obtained by applying a composition including the following ingredients at a gap of 0.0022":

| | |
|---|---|
| Water | 100.0 cc |
| Potassium hydroxide | 9.75 gms. |
| "Mineral colloid BP" | 20.0 gms. |
| Titanium dioxide | 60.0 gms. |
| Opacifying Dye of Formula A | 3.44 gms. |
| Opacifying Dye of Formula B | 2.30 gms. |

It will be seen that in the above formulation, the "Mineral Colloid BP" clay, in addition to preventing phase separation and hence permitting the use of the needed greater quantities of opacifying agent, serves also to provide the necessary viscosity for applying the composition in a thin uniform layer at the desired gap, thereby replacing the carboxymethyl cellulose viscosity-increasing agent. However, it is contemplated that some amounts of viscosity-increasing agent may be included in the last-mentioned formulation if found desirable or expedient to do so.

In addition to the advantages heretofore noted, it has further been found that the additives of this invention tend to make the opacifying dyes appreciably less migratory so that they remain in the processing composition layer, as intended, and not migrate to the dyeable stratum where they may be mordanted, causing a loss of color image quality. Moreover, when a color image prepared in the described manner is subjected to standard accelerated storage test conditions either at room temperature or at elevated temperatures, it has been found that images prepared in accordance with this invention possess more stability in the sense that the white (highlight) areas stay whiter and the dyes in the color (shadow) areas also appear more stable in terms of their spectral absorption characteristics. Accordingly, the use of the additives of this invention have been observed to provide improved stability in both the $D_{min}$ and the $D_{max}$ areas of the color transfer print.

Since certain changes may be made in the above product and process without departing from the scope of the invention herein involved, it is intended that all matter contained in the above description shall be interpreted as illustrative and not in a limiting sense.

What is claimed is:

1. A photographic film unit comprising as essential elements, a negative component which comprises at least one light-sensitive silver halide layer associated with a dye image-providing material and a positive component which includes at least a layer dyeable by the dye-image providing material and a quantity of an aqueous alkaline processing composition which provides silver halide developing agents for the light-sensitive layer said processing composition also including opaque layer-providing materials dispersed therein, said dispersed materials comprising an inorganic reflecting pigment and at least one pH-sensitive, organic, optical filter agent, said processing composition being adapted to be spread as a layer between said components so that said dispersed materials can provide an opaque layer between said components, said dispersed materials being characterized as having a tendency to undergo a phase separation whereby certain random areas of the so provided opaque layer suffer a reduction in the quantum of said reflecting pigment, said processing composition further including a photographically innocuous polysilicate cation exchange resin providing a cation exchange capacity between about 0.45 to about 2.70 millequivalents of cation per gram of resin, the amount of said cation exchange resin being sufficient to inhibit effectively said phase separation.

2. A film unit of claim 1 wherein said composition is confined in a rupturable container so positioned as to be capable, upon rupturing, of spreading said processing composition confined therein in a substantially uniform layer between said positive and negative components.

3. A film unit of claim 2 where the concentration of said polysilicate cation exchange resin is at least 3% by weight of the processing composition.

4. A film unit of claim 1 where said polysilicate cation exchange resin comprises a natural or synthetic clay.

5. A photographic film unit which comprises, in combination, a photosensitive element including in order, a composite structure containing, as essential layers, a dimensionally stable, opaque support layer; at least two selectively sensitized silver halide emulsion layers possessing predominant spectral sensitivity to separate regions of the visible electromagnetic spectrum; each of said emulsion layers having associated therewith in the same or in an adjacent layer, a dye image-providing material capable of providing, as a function of development, an imagewise distribution of dye image-providing material which is soluble and diffusible in an alkaline processing composition having a first pH, each of said dye image-providing materials possessing a spectral absorption range subsequent to processing substantially complementary to the predominant sensitivity range of its associated emulsion layer; an image-receiving element including in order, a stratum dyeable by said imagewise distribution; a layer possessing acid capacity effective to reduce the alkalinity of an alkaline processing composition possessing said first pH to a second pH at which said imagewise distribution of dye image-providing material is substantially non-diffusible and a dimensionally stable transparent layer; means for securing said layers in substantially fixed relationship; and means for retaining an aqueous alkaline processing composition possessing said first pH, said means being positioned so that on the application of compressive force, said processing composition having said first pH can be applied between said dyeable stratum and the selectively sensitized silver halide emulsion layer next adjacent thereto to provide silver halide developing reagents for said silver halide emulsion, said processing composition including opaque layer-providing materials dispersed therein, said dispersed materials comprising an inorganic reflecting pigment and at least one pH-sensitive, organic optical filter agent, said processing composition having a pH above the pKa of said optical filter agent and being adapted, upon application in a layer to evelop said exposed photosensitive layer(s) and to provide sufficient opacity during the development period to prevent fogging of said photosensitive layer(s) by actinic light incident on said applied layer of said dispersed materials when said film unit is developed in the presence of said actinic light, said dispersed materials being characterized as having a tendency to undergo a phase separation whereby certain random areas of said applied layer of said dispersed materials suffer a reduction in the quantum of said reflecting pigment, said composition further including a photographically innocuous polysilicate cation exchange resin providing a cation exchange capacity between about 0.45 to about 2.70 millequivalents of cation per gram of resin the amount of said cation exchange resin being sufficient to inhibit effectively said phase separation.

6. A film unit of claim 5 where said means for retaining said processing composition comprises a rupturable container confining said processing composition.

7. A film unit of claim 5 where said processing composition includes a viscosity-increasing reagent.

8. A film unit of claim 5 where the concentration of said polysilicate cation exchange resin is at least 3% by weight of said processing composition.

9. A film unit of claim 5 where said polysilicate cation resin comprises a natural or a synthetic clay.

10. A film unit of claim 5 where the concentration of said optical filter agent in said composition is so great as to result, in the absence of said polysilicate cation resin, in a further phase separation of said filter agent so as to render said applied layer of said composition incapable of effectively preventing fogging of said photosensitive layer from light incident on said applied layer during said development period and said concentration of said polysilicate cation exchange resin is sufficient to prevent effectively said further phase separation.

11. A film unit which comprises, in combination, a photosensitive element including a composite structure containing, as essential layers, in sequence, a dimensionally stable, alkaline solution impermeable, opaque layer; a redsensitive silver halide emulsion layer having associated therewith cyan dye; a green-sensitive silver halide emulsion layer having associated therewith magenta dye; a bluesensitive silver halide emulsion layer having associated therewith yellow dye, each of the cyan, magenta and yellow dyes being silver halide developing agents and being soluble and diffusible, in alkali, at a first pH; an alkaline solution permeable and dyeable polymeric layer; a polymeric layer containing sufficient acidifying capacity to effect reduction of a processing composition having the first pH to a second pH at which the dyes are substantially non-diffusible; a dimensionally stable alkaline solution impermeable transparent layer; means for securing said layers in substantially fixed relationship; and a rupturable container retaining an aqueous alkaline processing composition having said first pH, said container being adapted so that on the application of compressive force, said processing composition can be applied as a layer between said dyeable polymeric layer and the selectively sensitized silver halide emulsion layer next adjacent thereto to provide silver halide developing reagents for said silver halide emulsions; said processing composition including opaque layer-providing materials dispersed therein, said dispersed materials comprising titanium dioxide and at least one pH-sensitive, organic optical filter agent substantially non-diffusible from said composition when said composition is applied as a layer to develop an exposed film unit containing a developable image, said optical filter agent possessing a pKa below the pH of said composition whereby to exhibit at said pH maximum spectral absorption over a predetermined range, said titanium dioxide and said filter agent being present in a quantity sufficient upon application as a layer to provide to said applied layer an optical transmission density $>\sim 6.0$ density units with respect to incident actinic radiation and an optical reflection density $<\sim 1.0$ density units with respect to incident visible radiation, said dispersed materials being characterized as having a tendency to undergo phase separation whereby certain random areas of said applied layer of said dispersed materials suffer a reduction in the quantum of said reflecting pigment, said processing composition further including a photographically innocuous polysilicate cation exchange resin providing a cation exchange capacity between about 0.45 to about 2.70 millequivalents of cation per gram of resin, the amount of said cation exchange resin being sufficient to inhibit effectively said phase separation.

12. A film unit of claim 11 where the concentration of said polysilicate cation exchange resin is at least 3% by weight of the processing composition.

13. A film unit of claim 11 where said polysilicate cation exchange resin comprises a natural or synthetic clay.

14. In a photographic process wherein a photosensitive element which comprises a negative component including at least one exposed silver halide layer containing a developable image; said layer having a dye image-providing material associated therewith, said element further including a positive component comprising at least a dyeable stratum adapted for receiving a color transfer image by development of said photosensitive element and wherein said element is developed by applying, between said positive and negative components, an aqueous alkaline processing composition which provides silver halide developing reagents to said photosensitive element and said processing composition includes opaque layer-providing materials dispersed therein, said dispersed materials comprising an inorganic reflecting pigment and at least one pH-sensitive, organic, optical filter agent, said processing composition having a pH above the pKa of said optical filter agent and being adapted, upon application in a layer to develop an exposed photosensitive layer and to provide sufficient opacity during the development period to prevent fogging of said photosensitive layer by actinic light incident on said applied layer of said dispersed materials when said film unit is developed in the presence of said actinic light, said dispersed materials being characterized as having a tendency to undergo a phase separation whereby certain random areas of said applied layer of said dispersed materials suffer a reduction in the quantum of said reflecting pigment; the improvement wherein said processing composition includes a photographically innocuous polysilicate cation exchange resin providing a cation exchange capacity between about 0.45 to about 2.70 millequivalents of cation per gram of resin, the amount of said cation exchange resin being sufficient to inhibit effectively said phase separation.

15. A photographic process of claim 14 where the concentration of said dispersed materials is sufficient to provide upon application of said processing composition in a layer to develop said film unit, a layer exhibiting an optical transmission density $>\sim 6.0$ density units with respect to incident radiation actinic to said photosensitive layer and an optical reflection density $<\sim 1.0$ density units with respect to incident visible radiation.

16. A photographic film unit which comprises a plurality of sequential layers including a layer opaque to incident actinic radiation; a photosensitive silver halide layer having associated therewith a dye image-forming material for providing, as a function of development, an imagewise distribution of dye image-providing material which is soluble and diffusible in the processing composition employed to develop said film unit; a layer adapted to receive solubilized dye image-forming material diffusing thereto; and a rupturable container retaining an aqueous alkaline processing composition which can provide silver halide developing reagents for the photosensitive layer and which includes opaque layer-providing materials dispersed therein, said dispersed materials comprising an inorganic reflecting pigment and at least one pH-sensitive, organic, optical filter agent, said processing composition having a pH above the pKa of said optical filter agent, said rupturable container retaining said processing composition positioned so as to be capable, upon application of compressive pressure to said container, of discharging said processing composition between said silver halide layer and said receptive layer to provide a layer to develop exposed photosensitive layer(s) and to provide sufficient opacity during the development period to prevent fogging of said photosensitive layer(s) by actinic light incident on said applied layer of said dispersed materials when said film unit is developed in the presence of said actinic light, said dispersed materials being characterized as having a tendency to undergo a phase separation whereby certain random areas of said applied layer of said dispersed materials suffer a reduction in the quantum of said reflecting pigment, said processing composition further including a photographically innocuous polysilicate cation exchange resin in an amount sufficient to inhibit effectively said phase separation said cation exchange resin being selected from the group consisting of natural or synthetic clays and providing a cation exchange capacity between about 0.45 to about 2.70 millequivalents of cation per gram of resin.

17. A film unit as of claim 16 where said dye image-forming material is initially soluble and diffusible in said processing composition.

18. A film unit of claim 16 where said dye image-providing material is a dye developer.

19. A film unit of claim 16 including a polymeric layer containing sufficient acidifying capacity to effect reduction from the pH of said processing composition above the pKa of said optical filter agent to a lower pH below the pKa of said filter agent.

20. A film unit of claim 16 where the concentration of said polysilicate cation exchange resin is at least 3% by weight of said processing composition.

* * * * *